US005295268A

United States Patent [19]

Pociask

[11] Patent Number: 5,295,268

[45] Date of Patent: Mar. 22, 1994

[54] HANDSCOCK FOR COLD WEATHER GOLFING

[76] Inventor: Edward M. Pociask, 408 W. Walnut, Mt. Prospect, Ill. 60056

[21] Appl. No.: 986,121

[22] Filed: Dec. 4, 1992

[51] Int. Cl.[5] ..... A41D 13/10

[52] U.S. Cl. ..... 2/17; 2/16; 2/160

[58] Field of Search ..... 2/158, 17, 16, DIG. 6, 2/160, 159; 150/160

[56] References Cited

U.S. PATENT DOCUMENTS

| | | | |
|---|---|---|---|
| 1,302,766 | 5/1919 | Chambers | 2/17 |
| 3,638,284 | 2/1972 | Baker | 150/160 X |
| 3,774,242 | 11/1973 | Owen | 2/16 X |
| 4,351,067 | 9/1982 | Bartels | 2/160 |
| 4,698,851 | 10/1987 | Dunford et al. | 2/160 |
| 5,107,544 | 4/1992 | Capatosto | 2/16 |
| 5,168,909 | 12/1992 | Joyner, Jr. | 2/16 X |

FOREIGN PATENT DOCUMENTS

| | | | |
|---|---|---|---|
| 2399783 | 4/1979 | France | 2/DIG. 6 |
| 955041 | 4/1964 | United Kingdom | 2/17 |
| 2151127 | 7/1985 | United Kingdom | 2/159 |

OTHER PUBLICATIONS

"Strapet" Advertisement, Oct. 30, 1978 (2/DIG. 6).

*Primary Examiner*—Clifford D. Crowder
*Assistant Examiner*—John J. Calvert
*Attorney, Agent, or Firm*—Charles F. Lind

[57] ABSTRACT

This invention teaches a thermally insulated handsock for a golfer's hand for personal comfort when the golfer moves between consecutive golf shots during cold weather golfing, and further can be reliably secured to the golf bag, pull cart handle or riding cart steering wheel where the hand would normally be placed and needed in carrying the golf bag or pulling or steering the golf cart to remain stored in substantially the same place and orientation thereon when not being worn, as with the hand removed therefrom during a golf shot. The term handsock is used as there is no separate thumb pocket or contour, much like a sock, intended to fit over the golfer's hand (bare or with a golf glove thereon) including the thumb, to a depth with end opening possibly beyond the wrist. Paired tabs, with mating Velcro hook-loop fasteners thereon, generally at the palm region of the pocket and extended in line with the hand pocket, operate to secure the handsock in the operative position as needed with or without the hand being therein.

2 Claims, 1 Drawing Sheet

HANDSCOCK FOR COLD WEATHER GOLFING

BACKGROUND OF THE INVENTION

Many golfers stop playing golf when the outdoor temperatures drop to where keeping warm requires as much effort as swinging the clubs. This would be under 60° F. for some, under 50° F. for still others, or possibly not until the course is frozen solid or snow covered for the truly dedicated.

One overriding reason for discomfort is that cold tempertures mean cold hands, as most golfers prefer playing bare handed or with only thin golf gloves, for properly gripping and feeling the club. Having separate gloves to wear between shots is possible, but not real convenient or effective: first in putting them on and taking them off for every shot, and second in keeping track of them when off (on the ground or stuffed in your pocket, particularly if they are warm but bulky).

For example, an average golfer might take fifty shots from a tee or fairway lie, each requiring the selection of a specific club and a golf swing, and then requiring the movement of self and bag from that location on to the next lie. Each swing might take but seconds, and having the hands bare or in golf gloves can be tolerated for this duration as a condition of the sport. However, such needed self and bag movement to a next lie might take several minutes, when one's hands can get real cold. One's clothing pockets can provide a refuge from the cold, immediately before and after a shot, and for one hand during the needed self and bag movement. However, the hand rested on and stabilizing a shoulder carried bag or used for gripping a pull cart handle or a riding cart steering wheel remains exposed outside of all clothing pockets.

Once the hands are cold, the club becomes difficult to feel and grip, and the body becomes chilled for added discomfort.

SUMMARY OF THE INVENTION

This invention relates to an accessory in the form of a handsock device that can be conveniently worn on one's exposed hand for personal comfort when moving between consecutive golf shots during cold weather golfing, and stored when not being worn during a golf shot. The term handsock is used as the device has no separate thumb pocket or contour, much like a sock, but it is intended to fit over one's hand.

A basic object of the present invention is to provide a thermally insulated handsock that can be conveniently secured to and carried on the golf bag, pull cart handle or riding cart steering wheel, to be worn by the golfer only between golf shots, and that can be sized large to easily receive the golfer's hand (bare or with a golf glove thereon) and that will be located where the hand would normally be placed and needed in carrying the golf bag or pulling or steering the golf cart.

A specific feature of the handsock device is its paired adjacent separate hand and head pockets, open in the same direction and sized to fit simultaneously, respectively over one's hand and over the head of any golf club, typically the driver or long wood. As so positioned, the covered hand in the insulated hand pocket can rest on or grip the club head in the head pocket for balancing or stablizing the shoulder carried bag between shots, while further allowing easy hand removal and insertion when setting the bag down and picking it up again for each golf shot.

Another specific feature of the handsock device is its paired securable tabs, that can be secured to the golf bag, pull cart handle or riding cart steering wheel, to hold the device where needed when worn by the golfer between golf shoots and when carrying the golf bag, or pulling or steering the golf cart, again while allowing easy hand removal and insertion for any golf shot.

BRIEF DISCRIPTION OF THE DRAWINGS

Further objects, features and advantages of the present invention will appear from the following disclosure and description, including as a part thereof the accompanying drawing, in which.

DETAILED DESCRIPTION OF AN ILLUSTRATED EMBODIMENT

Figure 1:
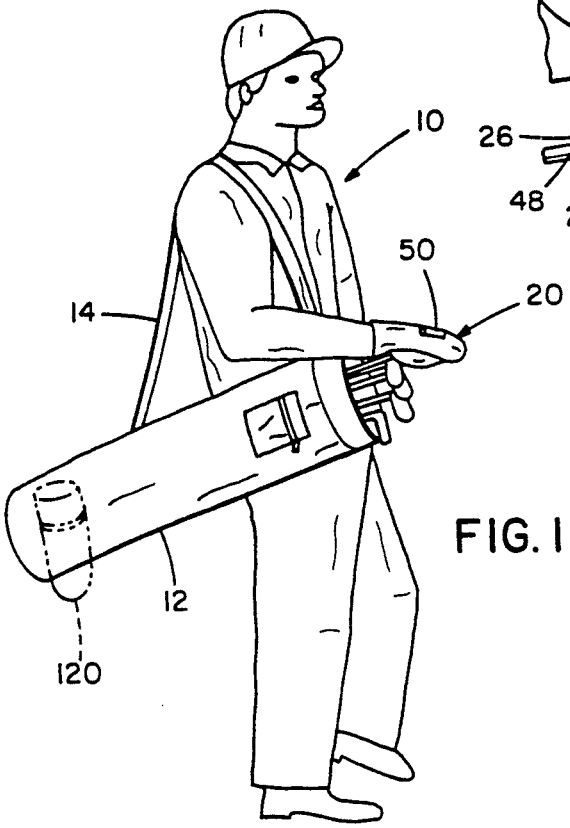
FIG. 1 is a side elevational view of a golfer carrying a golf bag, and using the handsock device forming this invention.

FIG. 1 shows a golfer 10 carrying a golf bag 12, with the bag strap 14 looped over the golfer's shoulder and the clubs and bag slightly inclined to present the open bag top and club heads higher than the closed bag bottom and forwardly of the golfer's body. The golfer commonly stablizes the bag 12 while carrying it around the course between golf shots by resting his hand 16 on the bag near its top or on the exposed club heads.

The inventive handsock device 20 is illustrated in place over the golfer's hand 16 and over the head 22 of a driver or long wood 24. The handsock 20 has a body formed of separate overlapping adjacent layers 26 and 28 joined together at edge seam 30, but separated at end 32 open to a hand pocket 34 defined between the layers. The hand pocket 34 is elongated and generally tubular, with one end closed, and is sized to easily receive the golfer's hand 16 (bare or with a golf glove thereon) including the thumb, to a depth with end opening 32 possibly beyond the wrist 36. Each layer 26 and 28 would be formed of durable flexible cloth material that provides thermal insulation, such as an outer nylon shell 38 and an inner thermal fill 40 of fur, wool, or a synthetic.

The handsock device 20 also has a separate overlapping adjacent layer 42 secured at edge seam 30, with its end 44 opening to a head pocket 46 defined between the layers 26 and 42. The head pocket 46 is also generally tubular, with one end closed, and is sized to easily receive the head of a golf club to a depth with end opening 44 overlying the club shaft 48. An elastic band 49 can be secured to the layer 42 at the open end 44, to allow the layer to be stretched open to fit over the club head 22 while then drawing the layer at the opening 44 tightly against the adjacent layer 26 and club shaft 48 for holding the device on the club head. The layer 42 would be formed of a durable flexible cloth material, such as nylon.

The defined hand and head pockets 34 and 46 respectively are paired and adjacent one another, and open in the same direction. The pockets 34 and 46 are sized to simultaneously hold respectively the golfer's hand 16 and the club head 22, including even the newer oversized drivers. The head pocket 46 would be large enough to fit over the head of other golf tools frequently carried in the bag 12, such as a ball retriever (not shown).

To use the handsock device 20 when shoulder carrying the bag 12, the golfer would slip the head pocket 46 over the head 22 of a selected long club or tool not regularly used, so that the device might stay secured thereon during most or possibly even all of the round. However, the device can be easily removed from the selected holding club or tool, should it be necessary, and placed then on any other club or tool head. The selected club or tool could be one of the longest in a bag, to have its head spaced from the open bag top for minimizing interference between the positioned device and other clubs or the bag top. As noted, a comfortable and common orientation of a golfer's hand when shoulder carrying a golf bag might be resting on and loosely grip a club head, for stablizing the bag while walking.

The hand 16 can be easily removed from the hand pocket 34 when setting the bag down, for selecting and removing a club from the bag and making the shot. The handsock device 20 generally will remain in place on the club head 22 yet in the bag. When thereafter picking up the bag and positioning the strap 14 over the shoulder, the hand 16 can be easily and almost automatically fitted into the hand pocket 34 of the handsock device 20 yet held in place on the club head 22.

Figure 2:
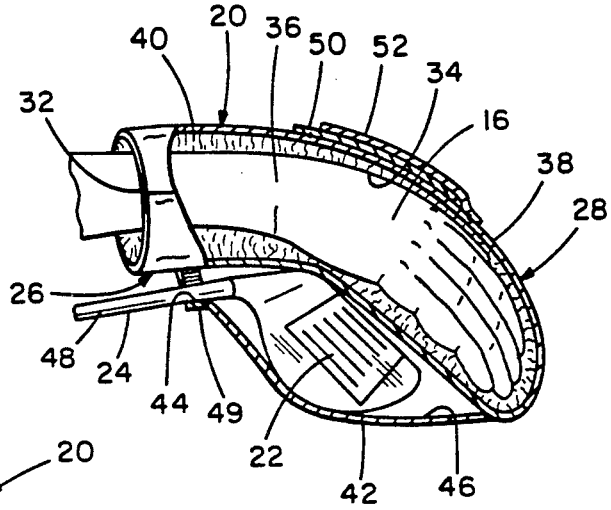
FIG. 2 is an enlarged partly broken away side sectional view, similar to FIG. 1, of the golfer's hand in the handsock device and cradled over the club head that holds the device.
Figure 3:
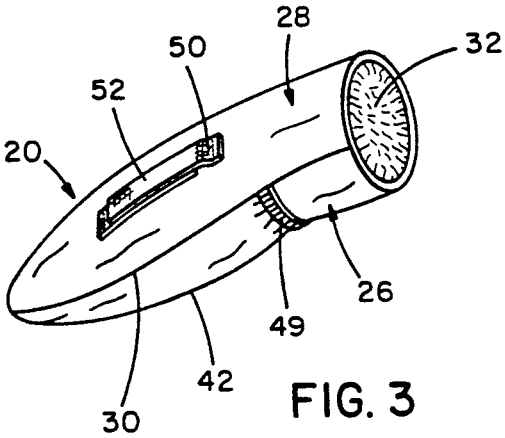
FIG. 3 is a perspective view of the handsock device, rotated almost half a turn end-to-end compared to FIG. 2.
Figure 4:
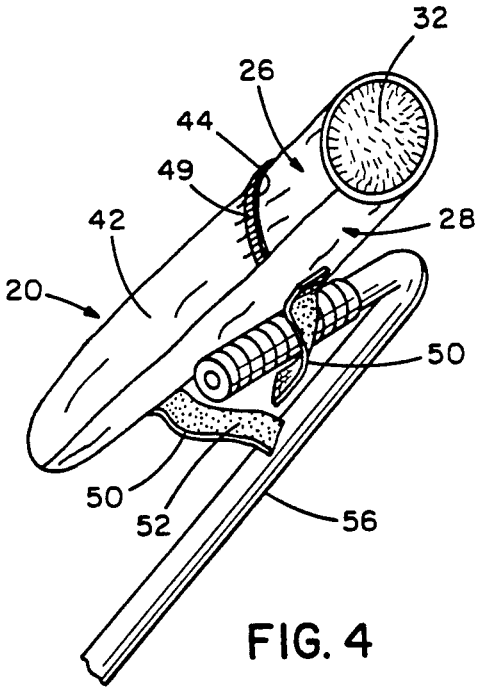
FIG. 4 is a perspective view of the handsock device about to be secured to the handle of a pull cart, the device being rotated about its long axis approximately half a turn compared to FIG. 3.

The handsock device 20 can further be used when golfing with a pull or riding cart. To provide for this, a pair of tabs 50 are secured at remote ends to the layer 28, spaced apart along the long axis of the device generally at the palm region of the device. Mating Velcro or other hook-loop fastener means 52 are on the free ends of the tabs. When not in use, the tabs 50 can be overlapped and secured together flat against the layer 28 (see FIGS. 2 and 3). Otherwise, the free tab ends are sufficiently long to be looped around and overlap one another to be secured onto the handle 56 (see FIG. 4) of a pull cart (not shown).

With the handsock device 20 secured to the cart handle 56 in this position, the golfer's hand 16 can be inserted into the hand pocket 34 and the fingers can be curved around the handle to grip and pull it. Likewise, the same separable tabs 50 can be secured onto the steering wheel of a riding cart (neither being shown), again positioned as needed for gripping the wheel and steering the cart. In both situations, the handsock device 20 will be held on the pull or riding cart when the golfer actually takes a golf shot, allowing for easy hand removal to take the shot and easy hand insertion thereafter to again operate the cart between shots.

Only one hand generally must be exposed during the golfer's movement between shots, that hand used for balancing the carried bag or pulling or steering the cart. The other hand can be kept warm by inserting it in a clothing pocket (not shown). However also, when shoulder carrying the bag 12, the other hand might be inserted into a second handsock device shown only in phantom at 120 in FIG. 1). This handsock would typically be held in place by the tabs being secured around a strap (neither being shown) looped and secured around the bag near its lower end. This handsock location allows for the other hand (left in FIG. 1) to be easily inserted into the handsock device 120 with the covered hand then being against the side and underside of the golf bag remote from the golfer's body, and the bag would be somewhat aligned crosswise of the golfer and across the backside of the golfer. When operating a riding cart, two like handsock devices can be secured to the steering wheel at spaced locations thereon, one for each hand.

With a pull cart, the second handsock device might be used, and conveniently stored when not in used during the actual golf shots, by leaving the tabs overlapped and secured but loose enough to be slipped on and off of the pull cart handle 56.

Without a separate thumb pocket or contour, the handsock 20 is interchangable for right or left hand use.

While a specific embodiment of the invention have been illustrated, it is apparent that variations may be made therefrom without departing from the inventive concept. Accordingly, the invention is to be limited only by the scope of the following claims.

What is claimed as my invention is:

1. A handsock for cold weather golfing, comprising the combination of two adjacent flexible durable cloth layers secured together in adjacent overlapping relationship at two opposed side edge portions and one end edge portion and separated at another end edge portion, defining therebetween an elongated and generally tubular hand pocket with the only opening thereto at the other end edge portion;

the two layers forming respectively back and front layers of the handsock;

the hand pocket being sized to easily receive a hand including the thumb, fingers and palm thereof, to a depth with the open other end edge portion beyond the wrist, whereupon the palm will lie against an inside of the front layer defining a palm region of the front layer;

each of the overlapping layers being formed of material providing thermal insulation; and a pair of tabs, each having two ends, secured on said palm region of the front layer by one of said two ends, with the secured ends of the tabs spaced apart along a line formed in the direction between the end edge portions, the other of the two ends of the tabs being non secured and mating releasable hook-loop fastener means thereon, and the tabs being sized to overlap the fastener means to releasably secure the tabs together and further to fit around several different structures of varying size and shape, operable to releasably and selectively secure the handsock to any of these several different structures and allow the wearer to grip a selected structure through the handsock and to readily insert the hand into and remove the hand from the handsock while yet having the handsock attached to said selected structure.

2. A handsock according to claim 1, comprising each of the overlapping layers being formed of an outer nylon shell and an inner thermal fill.

* * * * *